United States Patent [19]

Babb

[11] 3,983,337

[45] Sept. 28, 1976

[54] BROAD-BAND ACOUSTIC SPEAKER

[75] Inventor: Burton A. Babb, Dallas, Tex.

[73] Assignee: Babbco, Ltd., Dallas, Tex.

[22] Filed: June 21, 1973

[21] Appl. No.: 372,074

[52] U.S. Cl. ..... 179/115.5 R; 179/115.5 DV; 179/115.5 ES; 179/115.5 VC; 179/180; 179/181 R; 181/157; 181/172

[51] Int. Cl.[2] ..... H04R 7/14; H04R 7/18; H04R 9/02; H04R 9/04

[58] Field of Search ..... 179/114 R, 115 R, 115.5 R, 179/115.5 ES, 181 R, 138 R, 180; 181/157, 164, 166, 167, 168, 169, 170, 171, 172, 173

[56] References Cited

UNITED STATES PATENTS

| | | | |
|---|---|---|---|
| 1,720,008 | 7/1929 | Shapiro | 179/115 R |
| 1,870,417 | 8/1932 | Mallina | 179/115 R |
| 1,895,071 | 1/1933 | Fanger | 179/115.5 R |
| 1,975,201 | 10/1934 | Elworthy | 179/115 R |
| 2,004,735 | 6/1935 | Thomas | 179/115.5 VC |
| 2,013,792 | 9/1935 | Schafer | 181/169 |
| 2,235,654 | 3/1941 | Steers | 179/180 |
| 2,439,666 | 4/1948 | Marquis | 179/115.5 VC |
| 2,590,554 | 3/1952 | Lukacs | 179/115.5 VC |
| 2,661,412 | 12/1953 | Dreyfus | 179/115.5 R |
| 3,085,847 | 4/1963 | Massa | 179/115.5 R |
| 3,201,529 | 8/1965 | Surh | 181/171 |
| 3,403,235 | 9/1968 | Bishop | 179/115.5 R |
| R24,141 | 4/1956 | Brennan | 181/169 |

FOREIGN PATENTS OR APPLICATIONS

| | | | |
|---|---|---|---|
| 116,646 | 3/1943 | Australia | 179/115.5 VC |
| 968,234 | 11/1950 | France | 179/115.5 DV |
| 713,126 | 10/1931 | France | 179/115.5 |
| 1,126,904 | 12/1956 | France | 179/115.5 |
| 678,577 | 11/1930 | France | 179/115.5 VC |
| 1,092,061 | 11/1960 | Germany | 181/31 B |
| 315,501 | 7/1929 | United Kingdom | 179/115.5 R |
| 641,651 | 8/1950 | United Kingdom | 181/31 |
| 623,205 | 5/1949 | United Kingdom | 179/115.5 R |
| 1,035,995 | 7/1966 | United Kingdom | 179/115.5 VC |

*Primary Examiner*—George G. Stellar
*Attorney, Agent, or Firm*—Hubbard, Thurman, Turner & Tucker

[57] ABSTRACT

A very small audio speaker is described which has a broad-band electrical-mechanical transducer, a broad-band mechanical-air-transducer, and a special suspension system which combine to produce a substantially flat frequency response over substantially the entire audio range from about 50 Hz to about 18,000 Hz.

The broad-band electrical-mechanical transducer has either a voice coil with two axially spaced subsections, or a magnetic field with two axially spaced subsections, with the other being continuous between two effective boundaries. Each subsection of the coil, for example, is generally centered on the boundary of the magnetic flux field so that as one subsection moves into the flux field, the other subsection moves out of the flux field at the same rate, thus maintaining a linear force as the coil reciprocates through a much longer distance than is possible using conventional continuous coil and magnetic structures. The increased travel of the coil enhances low frequency performance while simultaneously preventing distortion of high frequency superimposed on the lows. The split coil achieves the long travel without increasing the weight of the coil or the inductance of the coil so that high frequencies can also be efficiently transformed.

Both the high and low frequencies can also be efficiently coupled to the air by a broad-band radiating surface characterized by transmission ribs which transmit the motional energy through the plane of the radiating surface at substantially the velocity of sound in air. A membrane extends between the transmission ribs to couple the energy transmitted radially by the ribs to the air. The coil and radiating surface are guided through the long travel by an anti-friction bearing positioned between the voice coil form and the magnetic center pole of the voice coil which introduces no spring forces to distort or retard the movement of the reciprocating members. Additionally, the bearing permits the tolerance between the coil member and the magnetic structure to be significantly reduced, which permits either an increase in the number of turns in the coil, thus increasing the force for a given diameter coil, or a reduction in the size of the magnet to produce the same force. The outer edge of the radiating surface is connected to a peripheral mounting flange by an edge suspension system which seals the annular space, maintains the cone axially aligned, and also exerts a minimum spring biasing force which returns the coil to the center of the magnetic field in the quiescent state. The edge suspension system includes a plurality of non-creeping spring elements, preferably spring steel to maintain long-term stability which are attached to, and damped by, a flexible rolled edge of graduated stiffness. The mid-sized driver is mounted in an unusually small air suspension enclosure.

39 Claims, 25 Drawing Figures

BROAD-BAND ACOUSTIC SPEAKER

This invention relates generally to loudspeakers and more specifically but not by way of limitation, relates to a full range loudspeaker having a unique high band pass electrical-mechanical transducer, a unique high band pass mechanical-air transducer, and a unique suspension system for the moving component of the electrical-mechanical transducer and all of the mechanical-air transducer.

Many human ears are capable of detecting acoustic energy from about 30 Hz to about 20,000 Hz. Music is moderately pleasing if it includes energy from about 150 Hz to about 12,000 Hz at uniform amplitudes for a uniform electrical signal, i.e., has a flat frequency response. However, most people seem to agree that a system which has the capability to produce energy in the 50 Hz range, which characterizes the deep bass notes which are felt by the body, and also the very high frequencies, which are primarily overtones of the lower musical notes, provides significantly more listening pleasure. Such systems are commonly referred to as the high fidelity or "Hi-Fi" systems. In many systems the bass response is actually boosted above that which would be considered flat.

Substantially all loudspeaker systems which produce broad-band audio energy, utilize a plurality of acoustic drivers in a common enclosure. Each driver is capable of operating with a flat response within a limited frequency band, and is driven through a cross-over network which directs the electrical signals within the respective limited frequency bands only to the appropriate driver. Any deficiencies in the response of the speaker within the band pass of the filter may be compensated electrically in the cross-over network or by use of a matched amplifier.

Systems using multiple speakers, cross-over networks and electrical compensation have achieved considerable acceptance in the market place. However, all of the systems are relatively expensive, with small increments in quality requiring considerably larger increments in cost. Further, even the best multi-driver systems have inherent distortion and "holes" in the frequency response as a result of cross-over networks and as a result of the mechanical suspension systems of the drivers. Also, multiple driver systems tend to be relatively large because of the large enclosure necessary to accommodate both the large diameter "woofer" driver necessary to produce the very low frequencies and also the "mid-range" and "tweeter" drivers for the mid and high frequencies. As a result, it is common practice to accept less than the best available systems because of space and cost considerations.

Many attempts have been made to design a single driver having a flat response over a wide band of frequencies because of the obvious potential advantages of lower cost, smaller size, and the theoretical possibility of improving the quality of the sound by eliminating the cross-over networks. This has proven very difficult because of the inherent conflict between the theoretically ideal system required to produce low frequency sound and that required to produce high frequency sound.

In order to produce good low frequency sound, a relatively large mass of air must be moved at the desired frequency. This can be achieved by moving a large diameter, rigid piston through a relatively short stroke, or a smaller diameter rigid piston through a longer stroke. It is also necessary to prevent the mixing of air pressure behind the piston with air pressure at the front of the piston because of the relatively long wave lengths of the lower frequencies. This would ideally be achieved by sealing the piston in a stationary wall or baffle of infinite dimension.

The theoretical criteria relating to the generation of high frequency sound are in direct conflict with the practical requirements for producing low frequency sound. The high frequencies require that the piston be accelerated at a high rate, thus ideally requiring a zero mass. A sufficiently low mass to produce high frequencies can be achieved by reducing the diameter of the piston, but a reduction in the size of the piston reduces the low frequency response. A coil designed to drive a large surface must be so large that the weight and inductance of the coil itself becomes a limiting factor at the upper end of the band pass.

Efforts to design a broad-band acoustic driver have been frustrated in the past at the electrical-to-mechanical motion transducer, specifically the magnet and coil assembly. Substantially all drivers utilize a tubular coil which is reciprocated through an annular magnetic flux gap in response to current through the coil. The limiting factor in almost every case turns out to be the magnetic flux saturation level of the cylindrical center pole of the magnetic structure. For a center pole of a given diameter and a magnet of sufficient strength to saturate the pole, there is a geometric limit to the axial length of a magnetic path of maximum strength. Since the force which can be produced by a small diameter saturated flux field is not adequate to drive a large diameter cone to generate good low frequency energy, the only alternative is to increase the length of the coil to provide a long travel. If the length of the coil is increased, however, the increased induction of the coil and the increased mass of the reciprocating member combine to prevent the high acceleration rates necessary for high frequency movement of the coil with a given input voltage. Both the magnitude and the linear distance over which a constant force can be produced by the transducer can be increased by increasing the diameter of the center pole and increasing the size of the magnet to keep the pole saturated. However, this also results in an increase in the induction and an increase in the weight of the coil and coil form, so that the increased force still cannot accelerate the coil sufficiently to increase the high frequency response even though it does improve the low frequency performance.

Even if a broad-band pass electrical-to-mechanical transducer could be constructed, the problem of coupling the mechanical energy to the air by a broad-band pass mechanical-to-air transducer remains to be solved. The radiating area of the ideal piston required to effectively generate low frequency acoustic energy, even when a long stroke is employed, is sufficiently great that the device must be made of as light material as possible just to provide good low frequency performance. As a result, the radiating surface is usually made as thin as possible, yet sufficiently rigid to produce low frequency acoustic energy. Even then the radiating surface is still so heavy that it limits the upper end of the band-pass. Further, for the frequencies having wave lengths less than the distance from the coil form to the edge of the radiating surfaces, there is the added danger that this portion of the radiating surface will flex and be out of phase, thus actually cancelling such high frequency energy as may have been passed through the electrical-mechanical transducer.

Even if the problems of providing a broad-band pass electrical-mechanical transducer and of transferring this broad band energy to the air by an effective broad-band radiating surface are solved, there is yet another major problem which must be satisfactorily solved in order to finally produce broad-band acoustic energy. The additional problem is to support the moving member of the electrical-mechanical transducer and the entire radiating surface which is the mechanical-acoustic transducer in such a manner as to guide the member along a predetermined axial path, to confine the member within certain limits along the axial path, and to seal the periphery of the radiating member with a surrounding stationary low frequency baffle. These three requirements must be accomplished without adding any significant weight to the member and without exerting any excessive mechanical spring force to the member beyond that required to bias the member to a center position in the quiescent state.

Another major problem with all known prior art speakers and particularly all speaker design presently in commerical use is creep of the suspension system. Most commercial speakers presently use cloth impregnated with a resin for both the rear suspension, i.e., the suspension system supporting and guiding the coil form, and also the rolled edge which assists in supporting and guiding the outer edge of the cone. These suspension systems have a marked tendency to sag or creep with age. This is particularly acute if the speaker is stored with the wire coil axis in the vertical position which often results in the coil being permanently centered away from the center of the magnetic field. This results in frequency doubling and distortion when the speaker is driven hard to produce large amplitude low notes. When the speaker is stored with the axis of the coil form and cone horizontal, the resulting sag of the suspension system often results in contact between the coil and magnetic structure. To counteract these problems, a relatively stiff suspension system is used or a large clearance left between the coil and magnet. In either case, the performance of the speaker suffers considerably.

In accordance with the present invention, a full range loudspeaker is comprised of a unique broad-band electrical-to-mechanical transducer which produces a constant force over a much greater distance than the conventional transducers of comparable size. The transducer utilizes a coil assembly of intermediate size and weight. The invention further provides a unique radiating surface of an intermediate size which effectively couples the long movement of the transducer to the air to produce low frequency acoustic energy. In addition, the effective or dynamic mass of the radiating surface is such that its weight combined with the weight of the coil of the electrical-mechanical transducer permits high frequency energy to reach discrete acoustic transmission paths. The transmission paths transmit the acoustic energy outwardly from the coil form at approximately the velocity of sound in air. The high frequency energy is coupled to a lightweight, low transmission velocity membrane along the high velocity transmission paths, and the membrane couples the high frequency energy to the air. Since the energy is transmitted in the plane of the radiating surface at the velocity of sound in air, substantially the entire radiating surface is in phase, thus providing a large in-phase radiating area with minimum mass loading on the coil. The invention further provides a unique suspension system for supporting the reciprocating coil assembly and radiating surface, while maintaining the reciprocating member precisely aligned along an axial path to permit closer spacing between the coil and magnet and thus greatly improve the efficiency. The suspension system also seals the annular space around the radiating surface while returning the member to a center quiescent position with long-term stability.

More specifically, the electro-mechanical transducer is comprised of a magnetic structure forming an annular magnetic flux field, and a coil assembly providing a tubular electric current field reciprocally disposed in the flux field. One of the fields, for example the flux field, is continuous and the other field, for example the current field, is divided into subfields, the centers of which are spaced apart the same distance as the distance between the effective edges of the flux field. In other words, the subfields are centered on the effective edges of the continuous field when in the quiescent state. An alternating current field created by applying voltage to the coil results in the conventional interaction between the fields which causes the coil to reciprocate relative to the magnet. As each subfield moves into the flux field, the other subfield moves out of the flux field at the same rate. As a result, a constant coupling force is produced between the two fields for an axial displacement of the coil that is several times that which is possible when both the current field and the flux field are continuous for the same total length.

The broad-band radiating surface is achieved by providing discrete high velocity transmission paths which extend radially outwardly from the coil form. Each transmission path preferably has a transmission velocity for acoustic energy resulting from axial movement of the coil form that is substantially equal to the velocity of the acoustic energy in air. More specifically, the transmission paths are ribs having an axial dimension many times the axial dimension of a conventional speaker cone and a circumferential dimension of the same order of magnitude as the conventional speaker cone. The ribs are typically fabricated of a synthetic plastic material such as polystyrene. These transmission ribs drive a membrane, of conventional thickness, and of conventional paper material if desired, along their entire length. While the amplitude of high frequency movement is reduced because the weight of the ribs is added to that of the thin surface, the amplitude of the high frequency sound produced by the surface is significantly increased due to the significantly increased area of in-phase radiating surface. The ribs incidentally stiffen the cone to enhance the low frequency performance, and the stiffer structure can be more effectively supported from the peripheral edge as will presently be described.

In accordance with another important aspect of the invention, suspension of the coil form and radiating surface is achieved by suspension system wherein the coil form assembly is slidably mounted directly on the magnetic structure and the periphery of the radiating surface is connected by spring means to a peripheral mounting flange.

More specifically, the tubular coil form is slidably mounted on the cylindrical center pole of the magnetic structure by suitable bearing means. The bearing means preferably includes a surface on one of the members formed of a synthetic material having a very low coefficient of friction, such as Teflon, and a suitable mating material, such as steel, nylon, aluminum, etc., on the other. The use of the sliding support or guide permits a maximum number of turns of a given diameter wire in a flux gap of a given radial width, thus materially improving performance. This is particularly significant when using the split coil of the present invention, as will hereafter be described.

In accordance with another specific aspect of the invention, the spring means supporting the periphery of the radiating surface preferably includes spring members fabricated of spring metal or glass or equivalent non-creeping material. The spring members are small filaments extending between the radiating surface and a peripheral support flange and are preferably attached to or incorporated in a flexible edge roll seal which dampens the natural resonance of the springs in addition to providing some spring force. The spring members preferably exert only enough mechanical spring force on the radiating surface and coil form to provide long term stability by biasing the coil to the desired quiescent position in the magnetic field. The flexible edge roll has a graduated stiffness to retard "blow-out" when operating with a small volume, high acoustic pressure enclosure.

The novel features believed characteristic of this invention are set forth in the appended claims. The invention itself, however, as well as other objects and advantages thereof, may best be understood by reference to the following detailed description of illustrative embodiments when read in conjunction with the accompanying drawings, wherein:

Figure 1:
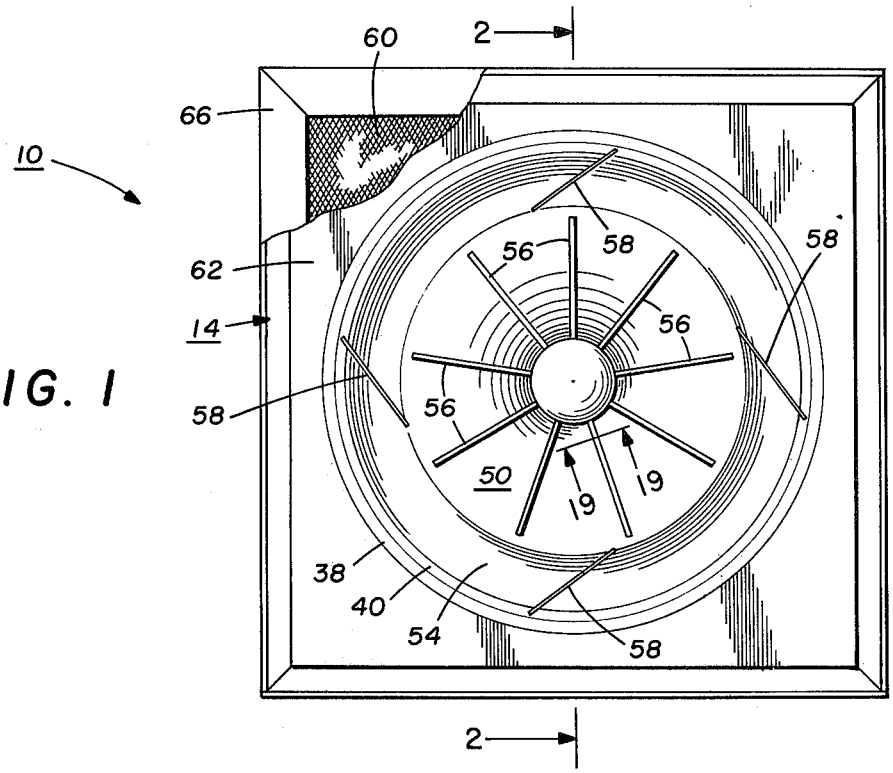
FIG. 1 is a front elevation view of a loudspeaker system in accordance with the present invention and particularly illustrates the mechanical-air transducer of the present invention.
Figure 2:
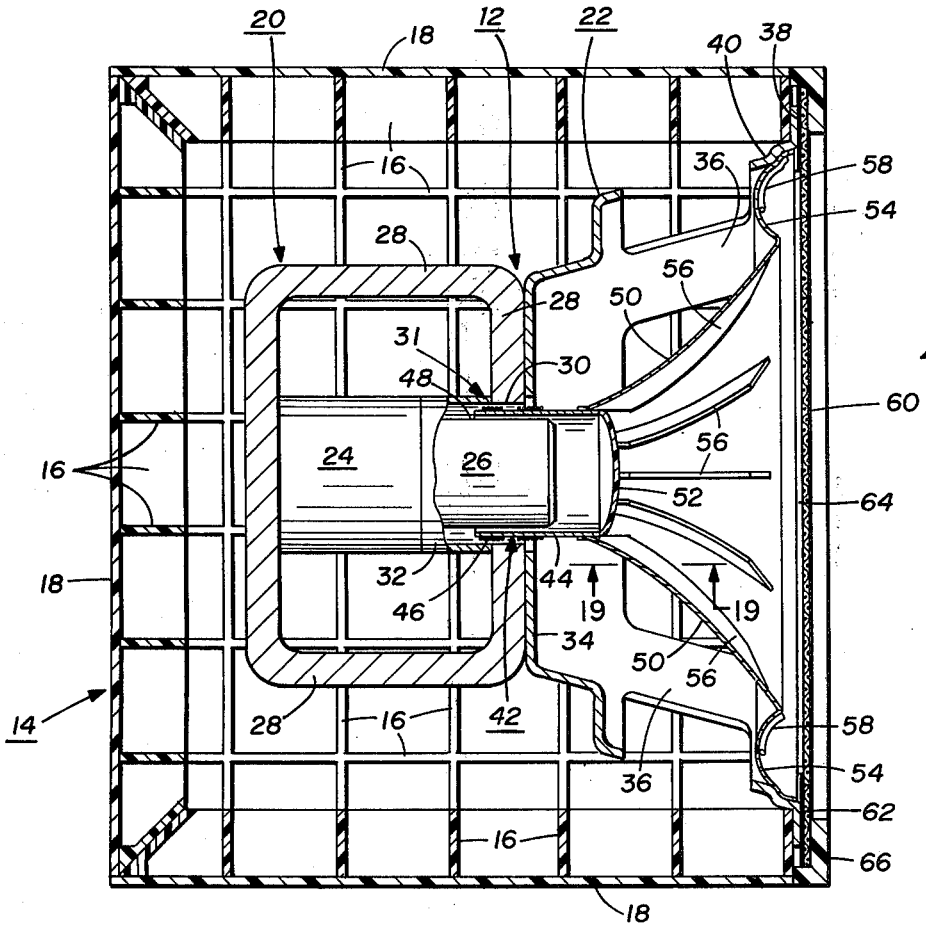
FIG. 2 is a sectional view taken substantially on lines 2—2 of FIG. 1.

Referring now to the drawings, an air suspension speaker system in accordance with the present invention is indicated generally by the reference numeral 10 in FIGS. 1 and 2. The speaker system is comprised of an acoustic driver, indicated generally by the reference numeral 12 and an appropriate enclosure indicated generally by the reference numeral 14.

The enclosure 14 is preferably of the type described and claimed in application Ser. No. 250,899, entitled "Speaker Enclosure", filed by Burton A. Babb on May 8, 1972, and assigned to the assignee of the present invention now U.S. Pat. No. 3,953,675. The enclosure 14 is comprised of a rigid network of ribs 16 and thin skin 18, which is bonded to the ribs. The ribs 16 are typically injection molded plastic from ½ to ¾ inch deep, on ¾ to 1 inch spacing. The thin sheet material 18 may typically be a plastic material such as formica, having a thickness of about 0.030 inch. Such an enclosure effectively blocks low frequency energy, yet transmits high frequency energy to a sufficient extent to prevent resonation within the enclosure. In addition, the enclosure occupies a minimum external space for a maximum internal air volume. These advantages are disclosed and claimed in detail in the above-referenced application.

The driver 12 includes a magnetic assembly, indicated generally by the reference numeral 20, which is supported on a stamped metal or plastic frame, indicated generally by the reference numeral 22 and commonly referred to as the basket. The magnetic assembly 20 is comprised of a magnet 24, a center pole piece 26, and an outer pole formed by metal loop 28. Loop 28 is connected to the rear end of the magnet 24 and has an aperture 30 which surrounds the cylindrical center pole 26 and thereby establishes an annular flux gap 31 between the edges of the aperture 30 and the center pole. A tubular dust cover 32 extends between the pole piece 28 and the magnet 24 and provides an annular cavity for a coil assembly presently to be described.

The pole member 28 is mounted on a center flange 34 of the basket 22. The center flange 34 defines a central aperture which registers with the aperture 30. The basket typically includes four legs 36, which extend from center flange 34 to a peripheral flange 38. The peripheral flange 38 includes a recessed shoulder 40 to which a spring and edge seal system is attached as will presently be described, and may be attached to the edge of the enclosure to provide both a mechanical connection to and an airtight seal with the enclosure.

The driver 12 also includes a reciprocating coil assembly indicated generally by the reference numeral 42. The coil assembly 42 is comprised of a tubular coil form 44 which may be formed of a thin, stiff cardboard or aluminum foil in the conventional manner. A wire coil 46 is wound on the coil form and both the coil form and coil are disposed in the annular flux gap 31. An anti-friction bearing 48 attached to the coil form between the coil form 44 and the center pole provides positive guidance for the coil form as it is reciprocated axially along the center pole 26 for purposes which will hereafter be described in greater detail.

A conically shaped acoustic radiating surface 50 is attached to the outer end of the coil form 44 and flares outwardly and forwardly toward the peripheral flange 38. A dust cap 52 seals the end of the coil form 44. The coil form 44, the cone 50, and the dust cap 52 may be of conventional materials and design. A plurality of acoustic transmission ribs 56 are attached along their entire lengths to the cone 50 and extend radially outwardly from the coil form 44 for purposes which will presently be described.

A flexible rolled edge seal 54 extends between the outer periphery of the cone 50 to the recessed shoulder 40 of the annular flange 38. A plurality of springs 58 are cemented to the shoulder 40 and follow the contour of the rolled edge 54 to points near the edge of the cone 50, for purposes which will presently be described in greater detail.

A conventional cloth speaker cover 60 may be mounted on a stiff sheet 62 having a central aperture 64, and the cloth and sheet 62 secured in place by a peripheral bezel 66 cemented to the edge of the enclosure 14.

Figure 3:
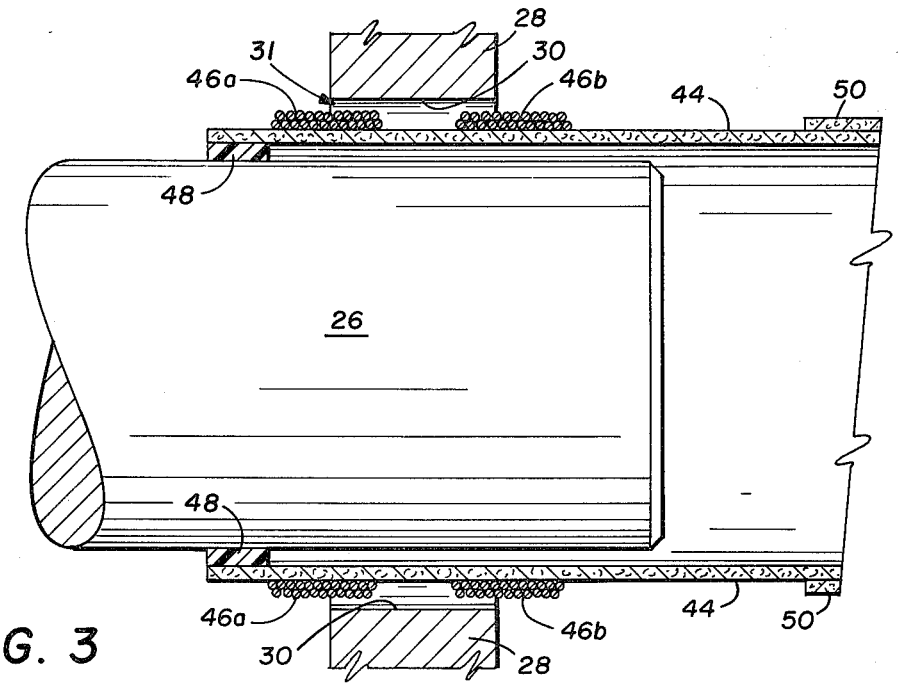
FIG. 3 is an enlarged partial sectional view similar to FIG. 2, illustrating one embodiment of the electromechanical transducer of the present invention and one embodiment of the suspension system of the present invention.

Referring now to FIG. 3, it will be noted that the coil 46 is formed in two distinct, axially spaced subsections, 46*a* and 46*b*. It will also be noted that the subsections 46*a* and 46*b* are of equal axial length, and are substantially centered at the opposite axial edges of the effective magnetic field extending between the pole members 26 and 28. The coil subsections 46*a* and 46*b* are formed from a continuous strand of wire, which may extend from the righthand end of subsection 46*b* along an inner layer applied directly on the coil form 44 to the lefthand end of subsection 46*b*, then extend directly to the righthand end of subsection 46*a*, then proceed to the lefthand end of subsection 46*a* as the bottom layer. The axial direction of the wire is then reversed to proceed from left to right along the lefthand subsection 46*a*, across the space between the subsections and then provide the second layer of turns extending from left to right of subsection 46*b*. The ends of the wire may extend along the coil form 42 and up the edge of the cone 50 to flexible braided conductors (not illustrated) extending from the cone to the legs 36 in the conventional manner.

Figure 4:
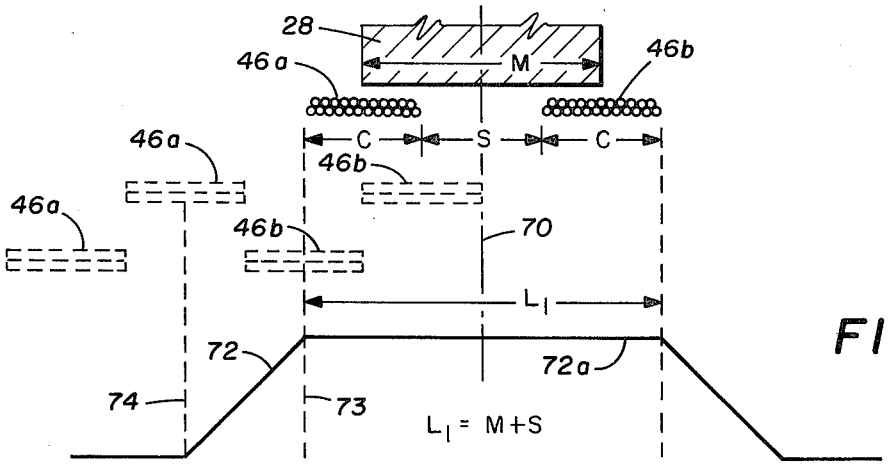
FIG. 4 is a schematic representation which serves to illustrate the operation of the electrical-mechanical transducer of the present invention which is illustrated in FIG. 3.
Figure 5:
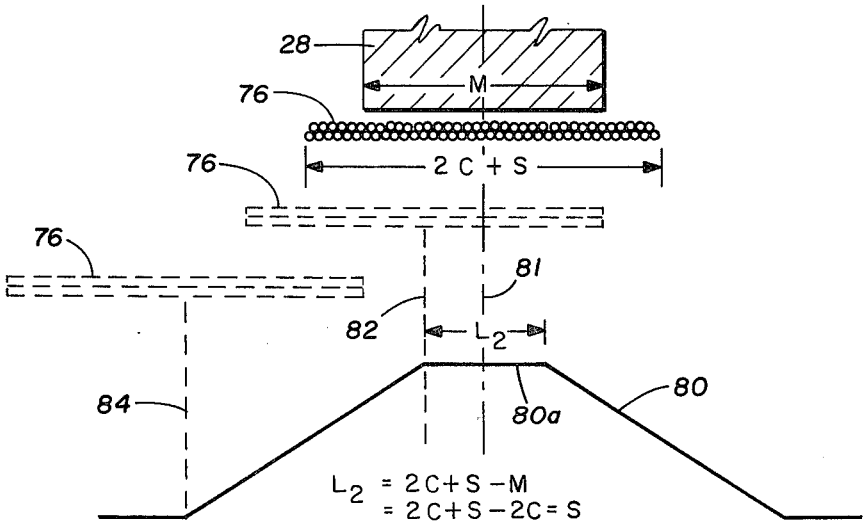
FIG. 5 PRIOR ART
FIG. 5 is a schematic representation similar to FIG. 4 which illustrates the operation of a typical prior art transducer.

The advantage of the split coil 46 is best illustrated by comparing FIG. 4, which illustrates the operation of the coil 46, with FIG. 5, which illustrates the operation of a conventional coil having a continuous coil with the same size wire and same number of turns per unit length. Referring to FIG. 4, assume an idealized condition where no flux fringing exists at the edges of the pole piece 30, so that the magnetic field is uniform for the axial length of pole piece 30. Assume that the electric current field produced by the subsections of the coil 46*a* and 46*b* each have an effective length exactly equal to the length of the respective coil sections. Then when coil 46 is centered on center line 70, the total number of turns of the coil within the magnetic flux field is represented by the flat portion 72*a* of curve 72. As the coil 46 moves to the left, coil subsection 46*a* leaves the magnetic field at the same rate that coil subsection 46*b* enters the magnetic field. As a result, the total number of turns of the coil subject to the magnetic field remains constant until the coil is centered on line 73. At this point, the number of turns within the magnetic field decreases linearly until the coil is centered on line 74, at which time no turns are within the magnetic field. The same thing occurs as the coil 46 moves to the right in FIG. 4, thus producing a curve 72 that is symmetrical about the center line 70. The curve 72 is an idealized representation of the potential force applied to the coil formed as a result of the coupling between the electric current field produced in the coil and magnetic field flux lines cut by the current paths in the current field. It is significant to note that the curve 72 is flat for a distance $L_1$, which is equal to the axial length of the effective field M plus the spacing S between the subsections 46*a* and 46*b* of the coil 46.

Now considering FIG. 5, assume that the same magnetic field 30 that is 2C long is used, but that a continuous coil 76 is used. Assume that continuous coil 76 has the same number of turns per unit of length at the subsections 46*a* and 46*b* of the coil 46, and that the total length of coil 70 is equal to 2C + S, which is the same as the total length of the coil 46. It will be noted that when the coil 76 is centered in the magnetic field produced by the pole piece 30, the total number of turns within the magnetic field is twice that of the coil 46, so that the idealized force represented by curve 80 is approximately twice that represented by the line 72 when the coil is in the center position 81, and the same current is passed through the coil 76. However, as soon as the coil 76 has moved C/2 to the left, to position 82, the number of turns of the coil in the magnetic field begins to decrease linearly until the coil is centered on line 84, when all of the turns of coil 76 are out of the magnetic field. Thus it will be noted that the length L2 of the flat portion of the curve 80 is equal to the length of the coil 2C + S minus the length of the Magnet M. Thus if S=C, for example, then $L_2=(2C=S)-(2C)=S$. Thus the flat region 72*a* of curve 72 would be three times as long as the flat region 80*a* of curve 80. On first inspection it would appear that the force on coil 46 would conversely be reduced to ½ the force on coil 76, which would be true for the same current levels. However, the inductance, resistance and weight of coil 46 are also reduced to ⅔ that of coil 76 so that for a given amplifier, the current materially increases and the net force produced by coil 46 approaches that of coil 76 in practical application.

Figure 6:
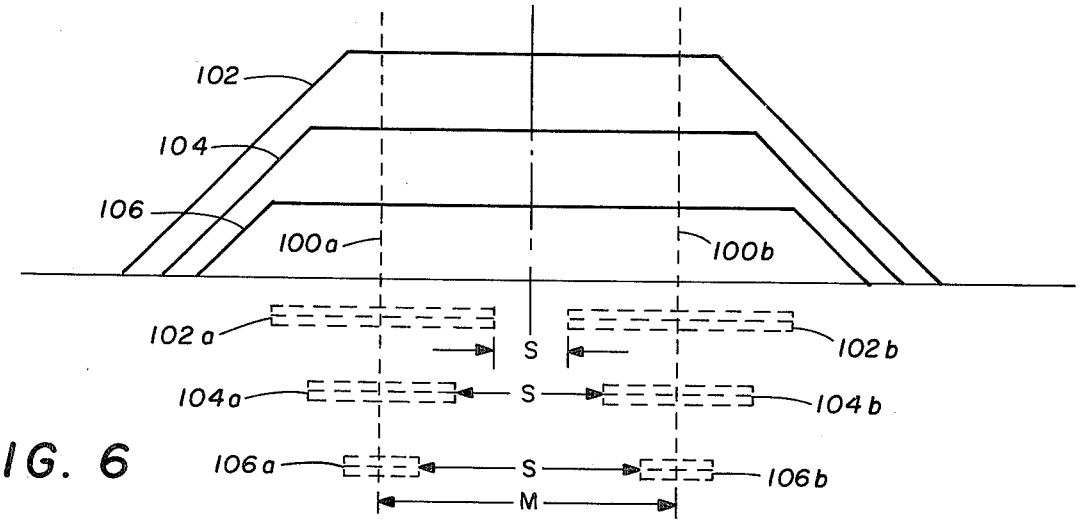
FIGS. 6, 7 and 8 are schematic diagrams which serve to further define and illustrate the operation of the electrical-mechanical transducer of the present invention.
Figure 7:
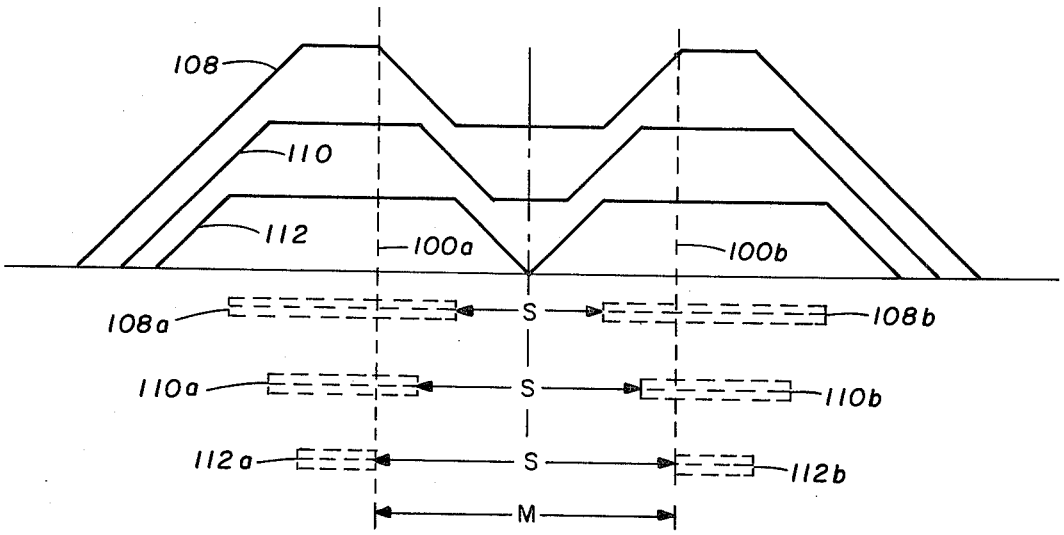
Figure 8:
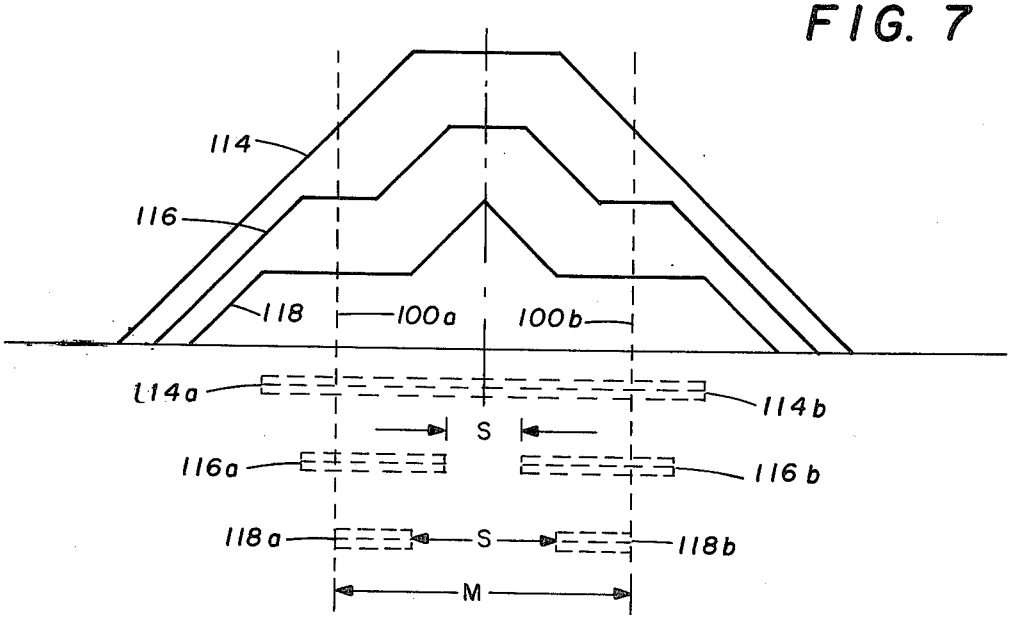

FIGS. 6, 7 and 8 illustrate the effects of varying the lengths of the coil subsections and of varying the relationship of the subsections to the effective edges of the magnetic field. Assume that the magnetic field M has an idealized or effective axial length of eight units, as represented by the dotted lines 100*a* and 100*b*. Assume also that a coil formed of subsections 102*a* and 102*b* and that each subsection has a uniform number of turns per unit of length and has an axial length of six units. Assume further that each subsection is centered on the effective edges 100*a* and 100*b* of the magnetic field. Curve 102 would then represent the total number of turns of the coil sections within the magnetic field as the coil section reciprocate about the center of the magnetic field. Thus it will be noted that six total units of the coils 102*a* and 102*b* are within the magnetic field during the flat center region of curve 102. It will also be noted that the flat region extends for a total axial distance of five units, at which time the left hand edge of coil subsection 102*b* begins to leave the magnetic field. The curve then drops linearly to zero when the coil subsection 102*b* is completely out of the magnetic field. The curve 102 is, of course, symmetrical about the center line of the magnet field and thus indicates a flat region having an axial length of ten units.

If a coil comprised of spaced sections 104*a* and 104*b*, each four units in length, are centered on the edges 100*a* and 100*b* of the magnetic field, curve 104 will represent the number of turns within the magnetic field as the coil moves through the magnetic field. It will be noted that a maximum total of four units are within the magnetic field for the flat region of the curve. However, it will be noted that the flat region of curve 104 now extends for a total of twelve units. Similarly, if a coil comprised of subsections 106*a* and 106*b* each only two units in axial length are centered on the edges 100*a* and 100*b* of the magnetic field, then curve 106 represents the total turns in the magnetic field. It will be noted that the total length of the constant force section of curve 106 is now fourteen units long, but that only two units of coil turns are within the magnetic field. Thus it is evident that the relation L=M+S holds true and that the linear region increases as the space between the coil sections increases.

FIG. 7 illustrates the effect of moving the centers of the coil sections outwardly from the idealized or effective edges 100*a* and 100*b* of the magnetic field. Thus placing a pair of coil subsections 108*a* and 108*b*, each six units in axial length in the off center position illustrated results in a total turns curve 108. Similarly, coil sections 110*a* and 110*b* which are four units in axial length results in curve 110, and coil sections 112*a* and 112*b* each two units results in curve 112. In each case, it will be noted that a significant dip in the number of turns within the magnetic field occurs as the coils are centered relative to the magnetic field which disrupts the constant force produced by the arrangements shown in FIG. 6.

The curves 114, 116 and 118 of FIG. 8 illustrate the consequences when the centers of coil sections 114*a* and 114*b*, 116*a* and 116*b*, and 118*a* and 118*b*, are positioned inside the effective edges 100*a* and 100*b* of the same magnetic field M. Since coil sections 114*a* and 114*b* are illustrated as being in contact, the curve 114 is actually that for a conventional structure and has a flat region equal to the total length of the coil less the length of the magnetic field. The total number of turns in the magnetic field while in the flat region is eight units which is the number of turns in a length of the coil equal to the length of the magnetic field. In the case of coils 116*a*-116*b* and 118*a*-118*b*, positioning the coil sections inwardly from the edges of the magnetic field results in the peaks in curves 116 and 118 and again disrupts the constant force profile illustrated in FIG. 6.

From the FIGS. 6, 7 and 8, it will be appreciated that the coil subsections should be centered on the effective edges 100*a* and 100*b* of the magnetic field M in order to achieve a constant force over a significant axial travel of the coil. It will also be noted that as previously mentioned, the axial length over which a constant amplitude force can be produced is equal to the axial length of the magnetic field plus the length of the space between the coil sections. It will be noted that the shorter the axial length of the coil sections, the greater the length of the linear region of magnetic coupling, in contrast to a continuous coil where the length of the linear region of the force curve is equal only to the length of the coil less the length of the magnetic field when the axial length of the coil exceeds the axial length of the magnetic field, or the axial length of the magentic less the axial length of the coil where the length of the magnetic field exceeds that of the coil.

It will also be appreciated that the relations of the magnetic field and coil can be interchanged so that the magnetic field is divided and the coil is continuous, with precisely the same theoretical and practical results. Such a structure is indicated generally by the reference numberal 130 and FIG. 9. The center magnetic pole 132 may be identical to the magnetic pole 26. The outer magnetic pole 134 has an annular opening 136 in which an annular groove 138 is cut to form two equal subsections 140*a* and 140*b*. The total axial length of the two subsections 140*a* and 140*b* may be equal to that of the outer magentic pole 28 plus the space between the subsections. The coil 142 is mounted on a coil form 144, which may be identical to the coil form 44. The coil 142 has an axial length equal to the distance between the centers of the sections 140*a* and 140*b* of the pole, so that the sections 140*a* and 140*b* are centered on the ends of the coil. Variations in the axial lengths and spacings of the pole sections 140*a* and 140*b* relative to the coil 142 will result in force curves identical to those illustrated in FIGS. 6, 7 and 8. Additional analysis will show that all other arrangements result in non-linear sections for the force curves. It will also be noted that the relationship of coils 104*a* and 104*b* is such that the force can be made linear indefinitely by providing additonal magnetic fields of the same length spaced apart by the distance M. Such an arrangement provides no practical advantages, however.

Referring again to FIGS. 3 and 6, it will be noted that as the axial length of the flat region of the curve increases for a magnetic field of given axial length, the total length of the coil must decrease, so that the total number of turns coupled to the magnetic field decreases. However, for a given number of sections, the inductance of the coil, the weight of the coil, and the resistance of the coil are reduced in proportionate amounts. As a result, the current is increased for a given amplifier, particularly for the high frequencies, so that the total force is not drastically reduced for a given signal source. As a result, the invention can be used to materially enhance the high frequency response of the speaker. In addition to improving the high frequency response, the increased length of the constant amplitude region also results in a material improvement in the low frequency response of the speaker. In addition, there is considerably less distortion of high frequency signals when superimposed upon low frequency signals because the force available to respond to the high frequency signals remains constant over the wide excursions resulting from the low frequency signals.

Another important aspect of the invention is the use of an anti-friction bearing, for example, bearing 48 in FIG. 3, between the coil assembly and the magnetic structure. The anti-friction bearing permits the coil form to reciprocate through a long axial distance without applying any axial spring return force to the coil. In addition, the bearing very accurately positions the coil form and thus the coil within the flux gap so that the clearance between the coil form and coil and the magnetic structure can be reduced. The bearing thus permits the use of a greater thickness of the layers of wire for the coil sections in a flux gap of a given radial dimension, when compared to conventional rear suspension systems. The advantage of using the bearing will hereafter be described in connection with the structure of FIGS. 10 and 11.

Conventional suspension systems normally use a corrugated drum-head or "rear suspension" which interconnects the basket flange 35 and the outer end of the voice coil form 44 (see FIG. 2). Such suspension systems have a dual purpose of providing radial alignment and also providing a force to return the coil to a centered axial position relative to the magnetic pole piece 28 when in the quiescent state. If the voice coil touches the pole piece audible distortion occurs because of the high coefficient of friction between the two surfaces. Even very low friction forces distort the sound, particularly at low amplitude. In addition, the friction quickly wears the voice coil until the speaker fails. This type of rear suspension, in order to provide adequate stability of the coil in the magnetic gap, must provide a substantial axial spring force which constrains and limits the axial movement of the coil assembly, and thereby limits the low frequency performance of the speaker. These rear suspension systems have substantial weight and substantial high frequency acoustic impedance due to the required large surface area. As a result, the conventional rear suspension impairs the high frequency performance of the speaker as well as having a non-linear spring constant which tends to distort the acoustic energy produced by the driver. In addition, the conventional rear suspension system tends to resonate at particular frequencies, like a drumhead, which also distorts the sound produced by the device. The bearing in accordance with the present invention may be any one of the embodiments as illustrated in FIGS. 2, 3, 9, 11, and 12 – 18.

Figure 10:
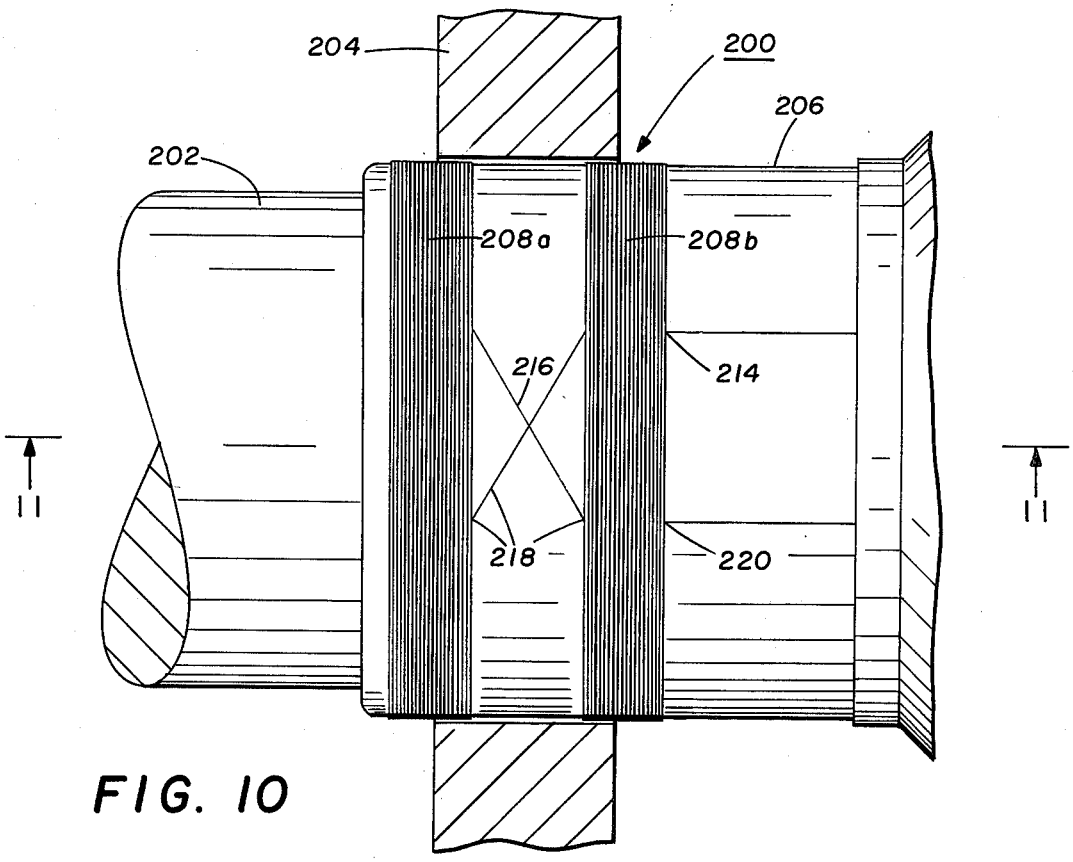
FIG. 10 is an enlarged view of an improved coil form in accordance with the present invention.
Figure 11:
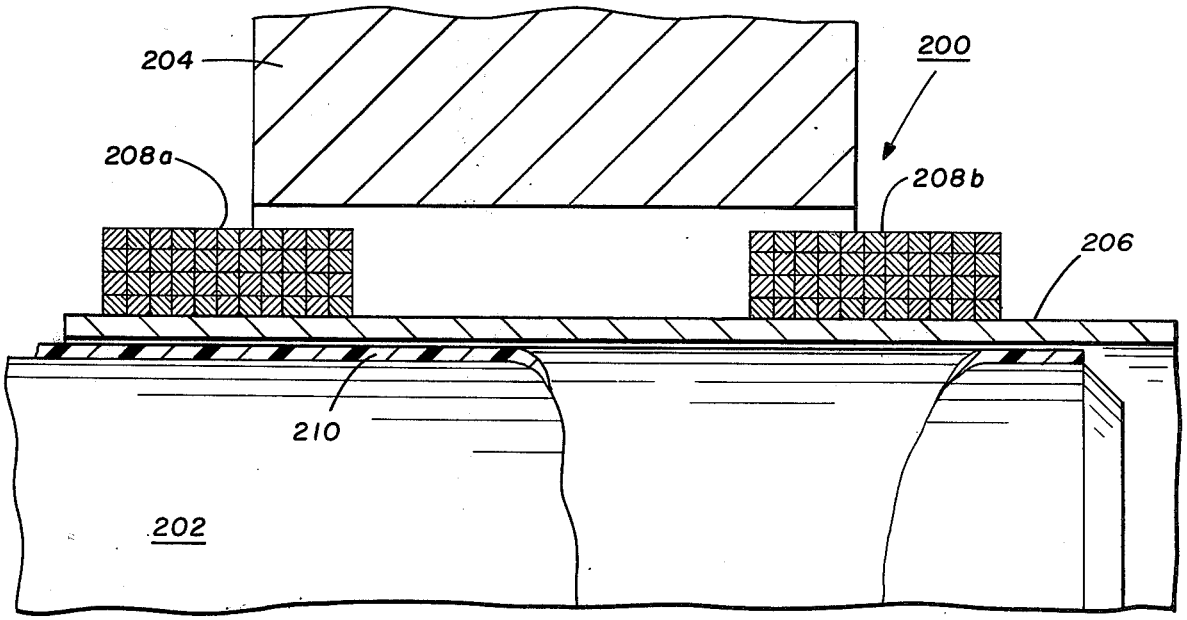
FIG. 11 is a sectional view taken substantially on lines 11—11 of FIG. 10.

A preferred embodiment of the electrical-to-mechanical transducer of the present invention which is made practical using the bearing system of the present invention is indicated generally by the reference numeral 200 in FIGS. 10 and 11. The system 200 has a magnetic structure which may be identical to that illustrated in FIGS. 2 and 3. The magnetic structure includes a magnet (not illustrated), a center pole 202, and outer pole 204 which form an annular flux gap as heretofore described. An aluminum coil form 206 carries axially spaced coil subsections 208*a* and 208*b* which are reciprocally disposed in the annular flux gap. One bearing surface may comprise a thin layer of Teflon 210 over the entire surface of the center post 202. The inside diameter of the coil form 206 is only slightly greater than the diameter of the Teflon coating and thus may be in continuous sliding contact over its entire length. As a result, the coil form 206 is very precisely positioned within the flux gap.

The coils 208*a* and 208*b* are formed by four layers of square wire configured substantially as illustrated in FIG. 11 to provide a tightly packed structure containing the maximum number of turns in a given cross-sectional area for a wire of given cross-sectional area. As a result, a maximum number of turns of the wire is provided per unit of axial length of each coil section.

The coil 206 may be formed by passing round wire through rollers as it is wound on the coil form. The wire may enter subsection 208*b* along path 214, and the first layer of section 208*b* wound. Then the wire may transition along path 216 to the first layer of section 208*a*, and then be stacked to form the second, third and fourth layers of section 208*a*. The wire may then return along path 218 to section 208*b* to complete the second, third and fourth layers of section 208*b*, then extend along path 220 to be connected to the signal source by a suitable conventional means (not illustrated). The coils 208*a* and 208*b* may be formed in the sequence just mentioned using conventional coil winding equipment. This is facilitated by using tape or other means temporarily placed on the coil form to act as "side boards" for the four layers of wire until the customary varnish is applied to the coils. Round wire can also be wound in four layers using the same technique.

It will be noted that the arrangement of the wires in coil subsections 208*a* and 208*b* provides the equivalent of about twice as many wires as can be reasonably placed in a magnetic flux gap of equivalent radial dimension using conventional coil assemblies. This is because considerable clearance between the coil assembly and magnetic structure is required when using the conventional rear suspension systems in order to assure that the coil and magnet will not touch during operation, particularly over a long period of time. As a result, the total force produced by the split coil assembly of the present invention can be maintained at a very high level and can still be maintained over the long travel previously discussed. Additionally, the close packing of the square wire enhances heat transfer between the wires and serves as a structural component to strengthen the coil form 206. It will be appreciated that the coil form 206 can conveniently be injection molded, extruded or machined from a suitable material having a low coefficient of friction with the Teflon coating 210. For example, nylon or polystyrene may be used as an alternative to the aluminum. The Teflon coat 210 may be applied to the center pole 202 using any suitable conventional coating process. It will also be appreciated that the surface of the outer pole 204 forming the flux gap may be coated with Teflon. Or both pole pieces may be coated with Teflon. Then if the axis of the coil form becomes askew to the axis of the flux gap or the coil form is out of round, the coil form may slide on either or both of the pole pieces. Further, it is to be understood that the coil form assembly may be coated with Teflon on either the interior or exterior surfaces, or both, and slide upon the metal of the pole pieces, or upon Teflon on either or both the pole pieces.

In a typical embodiment of the transducer of FIGS. 10 and 11, the center pole might be about 0.700 inch in diamater and the annular flux gap about 0.035 inch in the radial direction. The Teflon layer 210 might be 0.002 inch thick and the clearance between the Teflon and the coil form 206 about 0.001 inch. The coil form might be about 0.029 inch thick leaving a clearance of 0.005 inch between the coil form and the outer pole 204. The outer pole might be 0.200 inch in the axial dimension and the coil sections 208*a* and 208*b* disposed on centers spaced at 0.215 inch to allow for fringing of the magnetic field. Each coil section 208*a* and 208*b* might be 0.090 inch long and the two layers of wire occupy as much as 0.024 inch of the 0.029 inch radial dimension of the coil form.

Referring once again to FIGS. 2 and 3, another embodiment of the bearing 48 may conveniently comprise a continuous or interrupted strip of fibrous Teflon tape of the type conventionally used as a lubricant and a sealant in making threaded pipe couplings. Such material is flexible and easily conforms to the interior surface of the coil form 44. In addition, the material will automatically conform to the center pole 26. It will be appreciated that the center pole 26 is fabricated of iron and is conventionally turned with a high degree of precision, and thus provides a perfect cylinder and a good bearing surface upon which the Teflon may ride.

It has been found to be advantageous to increase the amplitude of the force in the constant force region of the curve by increasing the number of turns in the coil section as shown in the structure of FIGS. 10 and 11. In such a case, the weight, impedance, and inductance of the coil are substantially restored to the values of a continuous coil, yet the long travel at the high force level provided. This has the effect of reducing the brilliance of the high frequency of the driver while materially improving the response in the low frequency range, which has the overall effect of lowering the tone of the speaker to that which most people seem to find most pleasing. The increased impedance of the coil may better match certain amplifiers designed to be compatible with conventional eight ohm speakers. The impedance of the coil of the present invention may be controlled substantially as desired by connecting the various layers of the coil in parallel to decrease the impedance, so long as each series branch has the same number of turns in each subsection of the coil.

Figure 9:
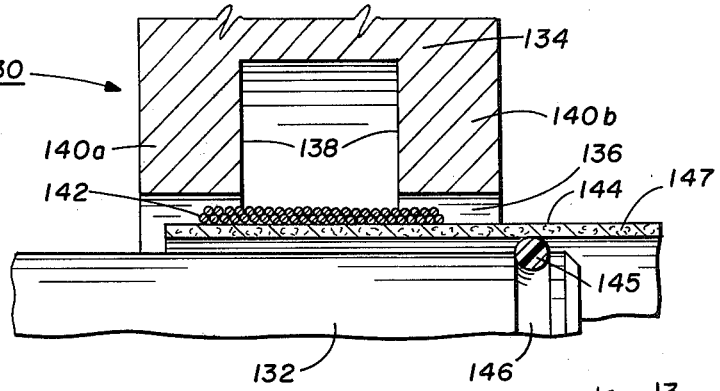
FIG. 9 is a partial sectional view similar to FIG. 3 illustrating an alternative embodiment of the electrical-mechanical transducer of the present invention and an alternative embodiment of the bearing of the invention.

An alternative method of providing a Teflon bearing on the center pole is illustrated in FIG. 9 where a Teflon ring 145 is snapped into an annular groove 146 in the end of the center pole 132. The coil form 147 may be made of aluminum or molded from a suitable plastic material having a low coefficient of friction with a Teflon ring, or maybe paper that has been coated or impregnated with such a plastic.

Figure 13:
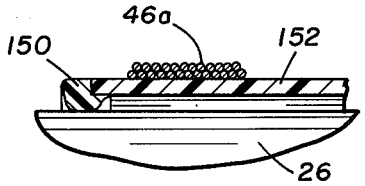
FIG. 13 is a sectional view taken generally on lines 13—13 of FIG. 12.
Figure 12:
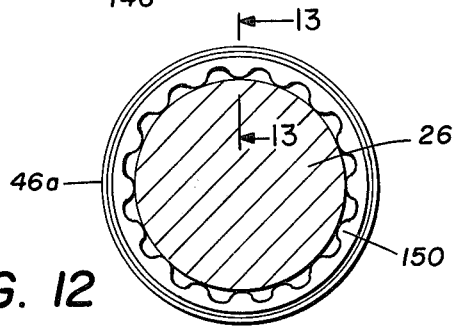
FIG. 12 is a simplified end view illustrating another embodiment of the bearing of the present invention.

In another embodiment of the invention, the bearing is molded as a ring 150 and inserted in a molded or conventionally formed coil form 152 as illustrated in FIGS. 12 and 13. The bearing 150 can be fabricated from any suitable bearing material, such as Teflon or other material having a very low coefficient of friction like Teflon with the iron of center pole 26. The bearing 150 can also be molded integrally with the coil form 152 particularly when the center pole is coated with Teflon as previously described. The bearing 150 may be interrupted as illustrated in FIG. 13 to provide a reduced contact area, or may be continuous around its entire periphery so as to provide a substantially continuous surface in engagement with the center pole 26. The bearing 150 is illustrated at the rear end of the coil form 150, but could be conveniently positioned at any point axially of the coil form which would allow the bearing to remain in continuous engagement with the center pole 26.

Figure 15:
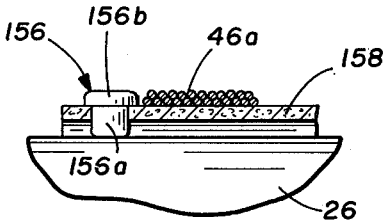
FIG. 15 is a sectional view taken substantially on lines 15—15 of FIG. 14.
Figure 14:
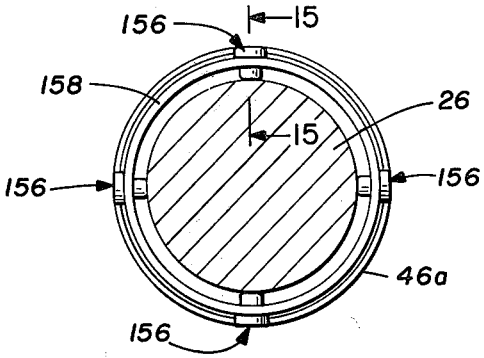
FIG. 14 is a simplified end view similar to FIG. 12 illustrating still another embodiment of the bearing of the present invention.

Still another form of the bearing in accordance with the present invention is illustrated in FIGS. 14 and 15. A plurality of bearing inserts 156 are positioned in apertures spaced around the periphery of a coil form 158. Each bearing insert has a shaft 156*a* which is received in the aperture and a head 156*b* which serves as an index to automatically position the end of the shaft 156*a* at the proper position.

Figure 16:
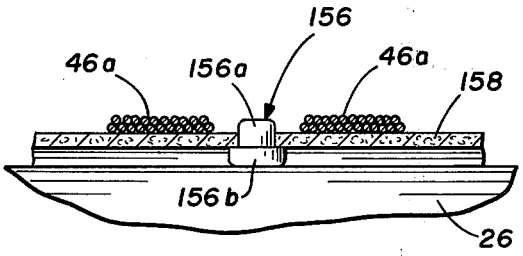
FIG. 16 is a sectional view similar to FIG. 15 illustrating still another embodiment of the bearing in accordance with the present invention.

Alternatively, the bearing inserts 156 may be positioned as illustrated in FIG. 16 with the heads 156*b* positioned ajdacent to the center pole 26 and the shaft projecting outwardly through the apertures in the coil form 158.

It will be noted that the bearing 156 of FIG. 16 is also centered between the coil sections 46*a* and 46*b*. This allows increased misalignment of the axis of the coil form from the axis of the center pole 26 during assembly without resulting in contact between the voice coil and the outer magnetic pole.

Figure 17:
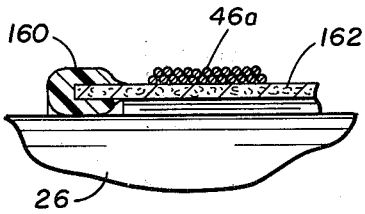
FIG. 17 is a sectional view similar to FIG. 16 illustrating still another embodiment of the bearing in accordance with the present invention.

Still another bearing in accordance with the present invention is indicated by the reference numeral 160 in FIG. 17. The bearing 160 is formed by dipping the end of a coil form 162 into a viscous solution of the bearing material and then allowing the bearing material to harden into a peripheral bead.

Figure 18:
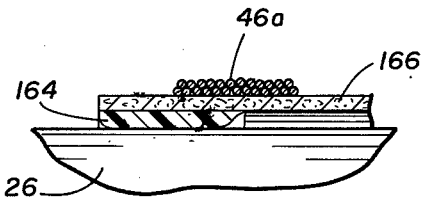
FIG. 18 is a sectional view similar to FIG. 17 illustrating yet another embodiment of the bearing in accordance with the present invention.

Yet another form of the bearing of the present invention is indicated by the reference numeral 164 in FIG. 18. The bearing 164 is formed by spraying or otherwise applying the bearing material in fluid form to a coil form 166 and allowing the bearing matereial to harden.

It is considered to be more desirable to provide the bearing between the coil form and the center pole because of various practical considerations. However, it is to be understood that the bearing may also be formed between the exterior of the coil assembly and the outer pole by providing a Teflon sleeve around the outside of the coil form and coil, either by applying a coating as a tubular sleeve which may directly contact the metal of the outer pole. Alternatively the surface of outer pole may be coated with Teflon and the outer surface coated with Nylon or other material which will form a good working surface with Teflon.

Figure 19:
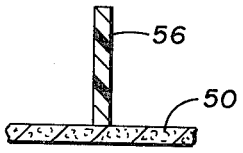
FIG. 19 is a simplified sectional view taken substantially on lines 19—19 of FIG. 1; or lines 19—19 of FIG. 2 showing details of a transmission rib in accordance with the present invention.

As previously mentioned, the present invention also provides a broad-band mechanical-to-air transducer which includes the cone 50 and transmission ribs 56 as shown in FIGS. 1, 2, and 19. The ribs 56 serve several functions. The most important function is to materially extend the frequency response of the cone in the high frequency range. The ribs also lessen distortion of the high amplitude low frequency notes when the driver is mounted in a low volume, high pressure enclosure. The ribs also aid in stabilizing the cone when using the peripheral spring support system of the invention.

The ribs 56 have an axial dimension selected such that axial vibratory motion applied to one end of the ribs will project radially outwardly along the ribs at approximately the velocity of acoustic energy in air. As a result, each discrete point along the ribs 56 remains in phase with the acoustic waves which are initiated in the air at the center of the cone as the result of motion of the coil form 44 and propagate outwardly along the face of the cone. For this reason, it is desirable to attach the inner ends of the transmission ribs 56 directly to the coil form to provide good mechanical coupling. Since the ribs 56 are attached to the cone along their entire length, the cone also remains substantially in phase with the radiating acoustic energy which is initiated at the center of the cone by motion of the coil form.

As previously mentioned, the cone 50 may be fabricated from conventional paper materials used to fabricate midrange speaker cones having a diameter of from 3 to 5 inches. This material is typically on the order of 0.02 inch. The transmission ribs 56, on the other hand, may be fabricated from a relatively stiff polystyrene material. It is very important that the axial dimension of the transmission ribs 56 be many times the axial dimension of the cone or membrane attached to the ribs in order to achieve the high propagation velocities. It is equally important that the axial dimension of the membrane and the circumferential dimension of the ribs be kept at a minimum in order to keep the overall weight of the transducer at a minimum satisfactory to produce the low and midrange. For example, when using nonfoamed polystyrene the axial dimension of the ribs should be on the order of 0.250 inch to achieve the desired maximum velocities. The design of the transmission ribs to achieve the desired transmission velocities is facilitated by considering following equation (1) which expresses the transmission velocity $v$ of sound waves in a rectangular rib having a thickness $t$ in the direction of vibration of the sound waves, a density $\rho$, and a stiffness expressed by Young's Modulus $\gamma$. The velocity $v$ is expressed in terms of the angular frequency $\omega$, the bulk transmission velocity C, and the radius of gyration K:

$$v = (\omega CK)$$

The angular frequency is:

$$\omega = 2\pi f$$

where $f$ is the driving frequency in Hz. The bulk transmission velocity is:

$$C = (\gamma/\rho)\ ½$$

where, as previously mentioned, $\gamma$ is Young's Modulus and $\rho$ is the dnesity of the rib material. The radius of gyration for a rectangular rib is:

$$K = t/v_{12}$$

Equation (1) can then be reduced to:

$$v = (\pi ft)½\ (\gamma/3\rho)¼$$

This transmission velocity is a function of frequency and can only be approximately matched to the velocity of sound in air which is $3.46 \times 10^4$ cm/sec. over the band of frequencies from 8,000 Hz to 16,000 Hz, which is the band where phase cancellation normally inhibits performance of larger diameter speaker cones.

Figure 20:
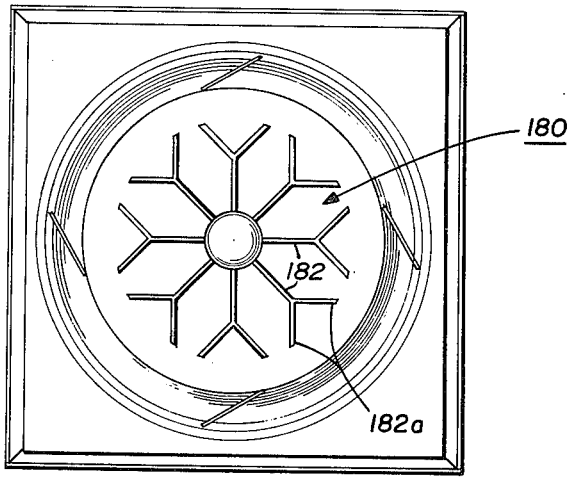
FIG. 20 is a front elevation of an alternative embodiment of the mechanical-air transducer of the present invention.

If the ribs are fabricated from polystyrene having a density $\rho = 1.05$ gm/cm$^3$, and $\gamma = 28 \times 10^9$ dyne/cm$^2$, then $C = 1.63 \times 10^5$ cm/sec. If $t$ of the rib is 3116 inch, then $v = 4.1 \times 10^4$ cm/sec., which is slightly higher than the speed of sound in air. But the true effective mass of the rib should include the reflected acoustic mass loading and the mass of the cone paper. This higher effective mass slows down the transmission velocity to just about match the velocity of sound in air. At 8,000 Hz the velocity would be about 20 percent less than the speed of sound in air, and at 16,000 Hz the transmission velocity would be about 20 percent greater than the speed of sound in air. These velocity matches are sufficiently good that significant phase cancellation will not occur for a full-sized speaker cone from about three inches to about eight inches in diameter. This is in contrast to a conventional speaker cone, which typically has thickness $t$ from about 0.020 inch to about 0.030 inch, in which case the radial transmission velocity out through the plane of the cone is about one-third the velocity of sound in air and where phase cancellation at 12 KHz occurs as soon as the cone radius exceeds about 1.5 inch. A circumferential dimension of about 0.020 inch for polystyrene ribs has proven more than adequate and has not overloaded conventional woofer cones as large as eight inches in diameter when arranged as shown in FIGS. 1 and 20. In general, it should be noted that the material should be as stiff as possible, as represented by having a high Young's Modulus, yet must have a low density. Synthetic plastics such as polystyrene are particularly suited for this application because these are easily fabricated, yet have the required physical characteristics. Aluminum is even better suited physically, but has disadvantages in the cost of fabrication. Very stiff cardboard having $\gamma$ and $\rho$ values approaching that of polystyrene can also be used effectively. Within the realm of practical reality, the dimension of the ribs normal to the radiating surface will vary from about 0.150 inch for aluminum to about 0.250 inch for polystyrene to about 0.300 inch for cardboard. The transverse dimension of the ribs parallel to the radiating surface of the membrane should be as small as possible to reduce the weight of the ribs and still prevent the rib from buckling. This dimension will normally be from about 0.010 inch to about 0.030 inch. To gain the proper perspective, the cone or membrane is typically about 0.015 inch normal to the radiating surface. Thus it will be noted that the dimension of the ribs normal to the radiating surface is at least about an order of magnitude greater than the dimension of the cone normal to the radiating surface and that the transverse dimension of the rib parallel to the radiating surface is of the same order of magnitude as the dimension of the cone normal to that surface.

An alternative embodiment of the mechanical-to-acoustic transducer in accordance with the present invention is indicated generally by the referenced numeral 180 in FIG. 20. The transducer 180 may be of the same construction as that illustrated in FIGS. 1 and 2 except for the configuration of the transmission ribs 182. Each transmission rib is branched or bifurcated at 182*a* so that the distance from a high velocity transmission path to any portion of the low velocity membrane is reduced to a dimension such that the membrane can be maintained in-phase with the acoustic wave in the adjacent air. This configuration has proven satisfactory for application to paper cones up to eight inches in diameter, in which case acoustic energy up to the upper limit of the audio range has been produced at substantially the same level as the low frequency energy produced by the large diameter cone. The axial and circumferential dimensions of the ribs 182 and 182*a* may be substantially the same as the ribs 56, since the axial dimension is selected as a minimum to provide the desired transmission velocity and the circumferential dimension is a minimum selected to keep the weight of the ribs at a minimum while preventing buckling.

The transmission ribs 56 may be attached to the paper cone using any suitable cement such as polystyrene dissolved with a vaporizable solvent. It is contemplated that the coil form 44, the dust cap 52, the ribs 56 and the membrane 50 will all be molded as an integral unit from polystyrene for high volume production. However, it may be more practical to mold this unit as two or more components which are subsequently cemented together to facilitate production.

The mechanical-air transducer comprised of the transmission ribs and membrane very significantly extend the high end of the frequency response of the speaker. This is true even though the particular cone used as the membrane is of a size and weight generally considered as a woofer or low-to-midrange speaker which is customarily combined with a tweeter to produce the full audio range which can be produced by the transducer using the transmission ribs. This is true even though the ribs add additional weight to the cone which would normally significantly further limit the high frequency response. This is true because the in-phase area of the transducer is greatly increased so that the total energy coupled to the air is increased even though the amplitudes of the high frequency movements of the structure are significantly reduced by the added mass.

The transmission ribs 56 also significantly rigidify the radiating surface of the cone 50 and thereby enable the cone to more effectively generate low frequency acoustic energy when the speaker is mounted in a small acoustic suspension enclosure. A small sealed enclosure, such as enclosure 14, behind the speaker of necessity builds up large acoustic pressures generated by the motion of rear surface of the speaker cone. These pressures are adequate to distort the speaker cone and thereby adversely affect the sound radiated by the front of the speaker cone.

The bearing suspensions of FIGS. 12 through 18 have infinite compliance in the axial direction, and all other variables being the same, a speaker playing a low frequency note and using the suspension of the invention will create significantly higher back pressures than with a conventional suspension. Also, the split voice coil, because of its flat coupling characteristic, can create large forces while in an extended position. The split coil is capable, when producing low frequency notes, of generating significantly larger forces than can be generated by a conventional coil. Both the bearing and the split coil have this high back pressure capability which means that loud low notes can be produced from a very small enclosure. But the resulting high back pressure occurring on these loud low notes make it even more imperative that the cone be extra rigid, so that it will not physically distort. In a conventional acoustic suspension speaker design, the use of the ribs aids in keeping the distortion level low when loud, low frequency notes are played. With the improved suspension and voice coil structures, the transmission ribs contribute very significantly to satisfactory loud low frequency performance when the speaker is mounted in the ultra-small enclosures to which it is suited.

As an additional benefit, the ribs 56 enhance the stability of the entire reciprocating structure when it is biased to a neutral position by spring force coupled to the outer perhphery of the cone, as will presently be described.

Figure 22:
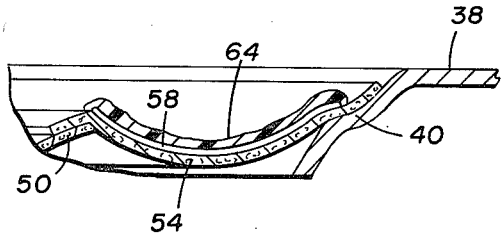
FIG. 22 is a sectional view taken substantially on lines 22—22 of FIG. 21.

The annular space between the reciprocating rigid cone 50 and the stationary annular flanges 38 may be sealed by any suitable conventional means. However, in accordance with one specific aspect of the invention, a modified conventional fabric edge roll 54 is preferably employed. The edge roll 54 includes a conventional woven fabric ring having a cross section as illustrated in FIGS. 2 and 22. The inner edge of the ring is bonded to the outer periphery of the cone 50, and the outer edge is bonded to the recessed shoulder 40 of the annular flange 38. When the driver 12 of FIG. 2 is mounted in the enclosure 14, which is preferably as small as possible, the pressures within the enclosure can become so great that the edge roll 54 reverses or "blows out" under the pressure as a result of the unique coil 46. The edge roll 54 is strengthened against such reversal by applying a stiffening material such as one or more layers of flexible cement to the outer and inner thirds of the surface of the roll 54 as indicated by the reference numeral **54*a* in FIG. 23 without noticeably affecting the performance of the driver. For example, FORMICA brand adhesive 140 Brushable Contact Cement which never completely hardens can be used to stiffen the woven fabric edge 54**. Such a coating results in an edge roll having a graduated stiffness. The blow-out force is a product of pressure, area, and moment arm, such that the center of the edge roll has no blowout flexing force, and the force increases quadratically towards either edge. The stiffness of the edge roll is graduated accordingly. This provides an optimum combination of high compliance and blow-out resistance, which facilitates the production of loud, low frequency sound.

Figure 21:
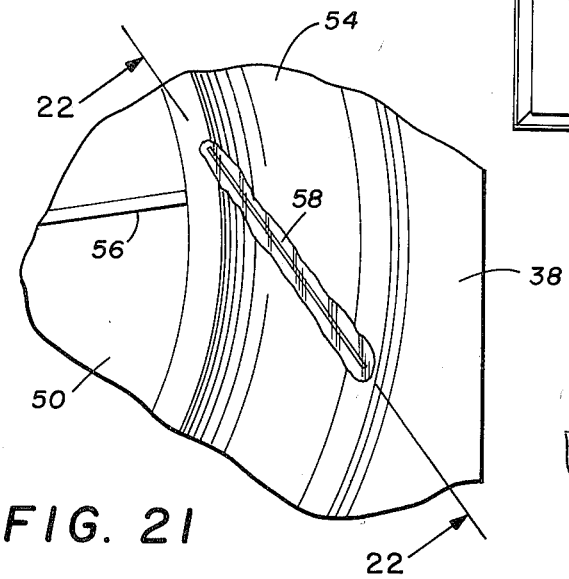
FIG. 21 is an enlarged view of a portion of the front elevation of the speaker illustrated in FIG. 1, and serves to illustrate a portion of the suspension system of the present invention.

As previously mentioned, the bearing support for the coil form introduces no spring bias to return the coil to a centered position in the magnetic field. The springs 58 provide spring bias to return the coil 46 to the center position relative to the magnetic structure. In addition, the combination of the anti-friction bearing 48 and the springs 58 connected to the outer periphery of te cone 50 as best illustrated in FIGS. 21 and 22 provides excellent axial stability to the reciprocating member while applying an extremely low spring force to bias the reciprocating member to a center quiescent position.

In accordance with an important specific aspect of the present invention, the springs 58 are formed of spring steel or other non-creeping material. The force of the springs need only be sufficient to support the reciprocating structure in the centered position when the axis of the coil form is vertical. In addition, the springs must permit full axial movement of the coil without contributing any excess spring force in order to minimize distortion of the acoustic energy produced by the driver.

It has been found that spring steel music wire having a diameter on the order of 0.007 inch provides the desired results when spaced at 90° points around the periphery of the cone 50. Wire as large as 0.010 inch in diameter and as small as 0.006 has been used successfully. In general, the smaller wire is preferred. The steel wires are permanently bent to a configuration corresponding to the cross section of the edge roll 54 as shown in the sectional view of FIG. 22. One end of each wire should be fixed to either the cone or the peripheral flange to provide a positive zero bias position. The outer ends may be conveniently attached to the portion of the edge roll 54 that is bonded to the shoulder 40 of the flange 38 in order to provide the positive static position. The inner end of the wire 58 need only extend to a point near the outer periphery of the cone 50 and preferably is not rigidly attached to the cone to provide, in effect, a pivoted connection with the cone. The entire length of each wire 58 is preferably flexibly cemented at 64 or otherwise attached to the edge roll 54 to dampen the natural resonance of the spring wire and prevent standing wave resonance.

Figure 23:
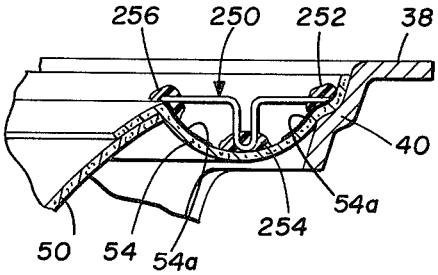
FIG. 23 is a simplified sectional view similar to FIG. 22 illustrating an alternative embodiment of the suspension system of the present invention.

An alternative embodiment of the spring for supporting the edge of the cone 50 is indicated generally by the reference numeral 250 in FIG. 23. The spring 250 may be formed of the same material as the spring 58 and positioned at the same circumferentially spaced points. However, the spring 250 is configured as illustrated and the outer end 252 is rigidly attached through the edge roll to the flange 38, the inner end 256 is rigidly attached to the edge of the cone 50, and the center 254 is attached to the center of the edge roll 54 to dampen the resonance of the spring. Contact cement may be used to attach the springs at the various points 252, 254, and 256.

Figure 24:
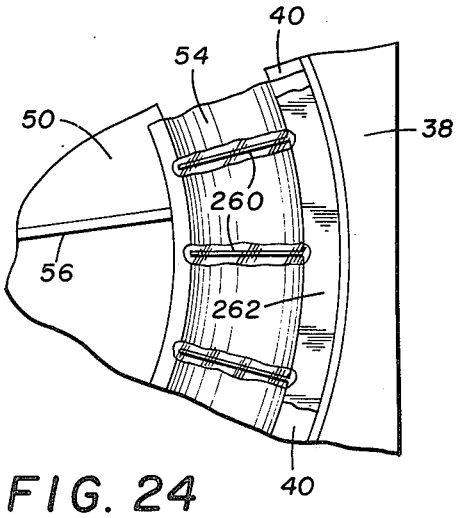
FIG. 24 is a partial front elevational view similar to FIG. 21 which illustrates another embodiment of the suspension system of the present invention.

The springs 58 and 250 assist in preventing "blow-out" or reversal of the edge roll 54 due to high pressures in the enclosure 14. This function can be enhanced by making the springs 58 from very small wire and substantially increasing the number of wires. Alternatively, the springs may be fabricated as illustrated in FIG. 24 to further prevent blow-out of the edge roll. In FIG. 24, a plurality of narrow arms 260 are formed integrally with a ring 262, which is sized to mate with the recessed shoulders 40 of the flange 38. The arms 260 and ring 262 may be simultaneously stamped and formed from a very thin sheet of metal which may subsequently be hardened to provide a non-creep spring material. The use of spring steel or other non-creep spring material is very important for long-term stability. The arms 260 and the ring 262 may then be bonded to the edge roll 54 over their entire surface. The spacing between the small arms 260 may be made close enough to assist the edge roll 54 in withstanding the pressures within the enclosure.

Figure 25:
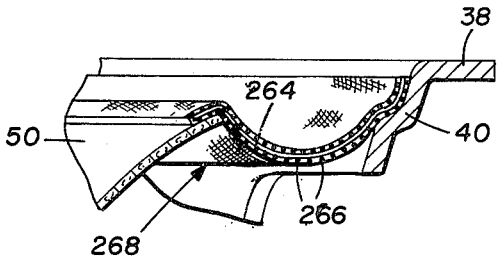
FIG. 25 is a simplified sectional view similar to FIG. 22 which illustrates still another embodiment of the suspension system of the present invention.

Still another embodiment of the invention is illustrated in FIG. 25 where the metal spring elements 264 are illustrated as being woven with the fibers 266 of a fabric edge roll 268. The spring fibers 264 then provide both the biasing and aligning functions while simulataneously assisting the edge roll in withstanding the pressure within the enclosure. The fabric also dampens resonance of the spring fibers as previously described.

From the above description of preferred embodiments of the invention, it will be appreciated that a highly unique loudspeaker has been described. The loudspeaker is capable of producing an unusually flat response over substantially the entire audio range, i.e., from about 50 Hz to about 20,000 Hz. This is made possible by the unique broad-band electrical-to-mechaical transducer which provides a linear force over a distance several times that available from conventional devices. In addition, a broad-band mechanical-to-air transducer is coupled to the electrical-to-mechanical transducer and effectively radiates the broad-band energy to the air. The operation of both of these transducers is materially enhanced by the unique suspension system of the present invention which includes a sliding bearing support for the coil form. This bearing permits a significant increase in the number of layers of windings which can be used for a given flux gap while simultaneously permitting long travel of the coil form without introducing a biasing force. The bearing structure also significantly reduced the cost of fabrication by reducing the costs of the parts and simplifying assembly. The second portion of the suspension system provides the necessary spring bias to center the coil assembly. By providing the springs at the periphery of the cone, the spring constant may be reduced and yet provide the long travel required of a cone. In addition, the biasing springs may be associated with the edge roll in such a manner that the edge roll dampens the spring and such that the spring reinforces the edge roll. The spring steel also provides the desired long-term stability.

It should also be noted that the spring return force is provided at the outer edge of the cone, where high frequency motions are of greatly reduced amplitude compared to those same motions near the voice coil. Therefore, the mass of the springs has very little effect on the high frequency performance of the driver.

While each of the components of the loudspeaker system described particularly complements the other components to produce a superior loudspeaker system, it will be appreciated that each improvement can also be used advantageously in more conventional speaker designs. More specifically, the divided coil structure has great utility in conventional speaker design. The bearing structure supporting the coil form may also be used to considerable advantage in conventional speakers, improving the performance obtainable with a given conventional magnetic structure and conventional continuous coil by permitting a significant increase in the numbers of turns per unit of length of the coil. The unique mechanical-to-acoustic transducer, i.e., the radiating surface, can also be used advantageously with more conventional electrical-mechanical transducers. The overall suspension system, including the coil form bearing and/or the peripheral springs and edge roll, may also be used to considerable advantage with conventional electrical-to-mechanical and mechanical-to-acoustic transducers because of improved performance and simplicity of manufacture. It should also be understood that various aspects of the invention may also be advantageously used vibration sensors, vibration generators, microphones, etc., in addition to loudspeakers and certain of the appended claims are intended to cover such applications.

The term "Teflon" as used herein refers to that class of materials described in *The Condensed Chemical Dictionary* and characterized by the well known low coefficient of friction of from about 0.04 to about 0.08. The term "low creep" spring materials includes spring metals such as spring steel, beryllium copper, phosphor bronze, and glass, and equivalent materials characterized by very long term stability even at very high temperatures. These spring materials are distinct from the class of long-chain synthetic materials and resins which have long term instability of "creep" resulting from the inherent thermoplastic characteristics of the materials.

Although preferred embodiments of the invention have been described in detail, it is to be understood that various changes, substitutions and alternations can be made therein without departing from the spirit and scope of the invention as defined by the appended claims:

What is claimed is:

1. In an acoustic transducer, the combination of:

a magnetic assembly having an annular flux gap formed between a cylindrical center pole of uniform diameter and an outer pole disposed around the center pole;

a coil assembly including a tubular coil form means reciprocally disposed in the flux gap, the interior of the coil form means having a plurality of circumferentially spaced, Teflon bearing surfaces in continuous sliding contact with the uniform diameter of the cylindrical center pole to guide the coil form means relative to the magnetic assembly;

means forming an acoustic radiating surface attached to the coil assembly and reciprocated by the coil assembly when an electrical signal is passed through the coil; and means for providing a peripheral air seal between the radiating surface and a stationary baffle.

2. In an acoustic transducer, the combination of:

a magnetic assembly having an annular flux gap formed between a cylindrical center pole having a free end and an outer pole disposed around the center pole, the cylindrical center pole having a constant diameter for at least the length of the flux gap and no greater diameter than the constant diameter between the flux gap and the free end of the center pole, the constant diameter forming a continuously cylindrical bearing surface extending into the flux gap;

a coil assembly including a voice coil wound on a tubular coil form and reciprocally disposed in the flux gap, the coil form having an internal Teflon bearing surface in continuous sliding contact with the cylindrical bearing surface including a portion of the bearing surface within the flux gap to guide the coil form means relative to the magnetic assembly, the Teflon bearing surface being formed by a substantially continuous ring of Teflon and the bearing surface having an axial length substantially shorter than the coil form means and being disposed near the end of the coil form remote from the means forming the radiating surface;

means forming an acoustic radiating surface attached to the end of the coil assembly beyond the free end of the center pole and reciprocated by the coil assembly when an electrical signal is passed through the coil; and means for providing a peripheral air seal between the radiating surface and a stationary baffle and radial support for the radiating surface.

3. The combination of claim 2 wherein the Teflon bearing surface is circumferentially interrupted to reduce the area of contact of the bearing.

4. In an acoustic transducer, the combination of:

a magnetic assembly having an annular flux gap formed between a cylindrical center pole and an outer pole disposed around the center pole;

a coil assembly including a tubular coil form means reciprocably disposed in the flux gap, said coil form means being in continuous sliding contact with the magnetic assembly to guide the coil form means relative to the magnetic assembly;

means forming an acoustic radiating surface attached to the coil assembly and reciprocated by the coil assembly when an electrical signal is passed through the coil; and means for providing a peripheral air seal between the radiating surface and a stationary baffle and radial support for the radiating surface, said means also axially biasing the radiating surface to a predetermined axial position and providing essentially the only axial bias to the radiating surface and the coil assembly, and including a plurality of spring metal members cantilevered from the peripheral support flange and extend toward the peripheral edge of the means forming the acoustic radiating surface.

5. The acoustic driver of claim 4 wherein the support means further includes a flexible membrane extending between the peripheral edge of the means forming the radiating surface and the peripheral support flange to provide the air seal and the membrane is attached at least to a midpoint of each of the spring metal members to dampen resonation of the spring members.

6. The transducer comprising a magnetic assembly forming a flux gap, a coil assembly having a coil reciprocally disposed in the flux gap, means forming an acoustic radiating surface attached to the coil assembly and having a peripheral edge, means forming an annular opening around the peripheral edge, a flexible membrane sealing the annular opening while permitting reciprocation of the means forming the radiating surface, and a plurality of circumferentially spaced spring means disposed between the means forming the radiating surface and the means forming the annular opening for applying a spring biasing force to the means forming the radiating surface, the spring means being characterized by having a resonant frequency in the audible range, the spring means and the flexible membrane being interconnected to dampen the resonance of the spring means in the audible range.

7. The transducer of claim 6 wherein the membrane is a woven fabric and has a generally semi-circularly shaped radial cross-section.

8. The transducer of claim 6 wherein the spring means if formed of spring metal.

9. The transducer of claim 6 wherein the spring means is formed of a glass.

10. The acoustic driver comprising:

magnetic means forming an annular flux gap having an axis;

a tubular coil form having a voice coil thereon disposed in the flux gap for reciprocation coaxially with the flux gap;

a thin, acoustic radiating membrane fastened to the coil form having an axis coaxial with the axis of the flux gap and coil form; and a plurality of rib members coupled to the coil form by means for transmitting acoustic energy at frequencies above about 8,000 Hz and radiating outwardly from the coil form, each rib member being coupled along its length to the membrane by means for transmitting acoustic energy at frequencies above about 8,000 Hz to the adjacent portion of the membrane, each rib being fabricated from a material of high rigidity and having its major cross sectional dimension-disposed substantially at a right angle to the membrane surface, each rib having, when coupled to the membrane, a longitudinal transmission velocity at least near the coil form for acoustic vibrations parallel to the axis of reciprocation between 8,000 Hz and 16,000 Hz that is equal the velocity of acoustic energy in standard air.

11. The acoustic driver of claim 10 wherein the transverse dimensions of the ribs normal to the radiating surface are greater than about 0.150 inch, the transverse dimensions of the ribs parallel to the radiating surface are less than about 0.035 inch, and the dimension of the membrane normal to the radiating surface is less than about 0.035 inch.

12. The acoustic driver of claim 10 wherein the membrane is formed of lower density paper and the rib sections are fabricated from a material selected from the group comprising synthetic plastic, aluminum, and higher density paper.

13. The acoustic driver of claim 12 wherein the rib sections are synthetic plastic.

14. The acoustic transducer comprising the combination of:

magnetic means for producing an annularly shaped magnetic field including a cylindrical center pole member and a circular outer pole member disposed around and spaced from the center pole to form the annularly shaped magnetic field therebetween;

coil means forming an annularly shaped alternating current field disposed in the annularly shaped magnetic field for reciprocation axially of the center pole;

one of the fields being continuous and the other field being divided into axially spaced rigidly interconnected subfields of substantially equal frequency response, the subfields being spaced such that as th current field moves in one direction relative to the magnetic field, one of the subfields is coupled to said one field to an increasing degree and the other of the subfields is coupled to said one field to a decreasing degree, and as the current field moves in the other direction relative to the magnetic field, said one of the subfields is coupled to said one field to a decreasing degree and said other subfield is coupled to said one field to an increasing degree to thereby maintain a substantially constant degree of coupling between the two fields over a substantial distance of relative movement;

an acoustic radiating surface attached to and reciprocating axially with the coil means and having an outer periphery;

a rigid support member attached to the magnetic means and including an annular flange disposed adjacent the outer periphery of the acoustic radiating surface; and axially flexible means providing an annular air seal between the periphery of the radiating surface and the annular flange while providing radial alignment for the radiating surface.

15. The combination of claim 14 wherein the current field is divided into subfields.

16. The combination of claim 14 wherein the magnetic field is divided into subfields.

17. The combination of claim 14 wherein the distance between centers of the subfields is approximately equal to the distance between the effective boundaries of said other field.

18. The combination of claim 14 wherein the means forming the elongated magnetic field includes a permanent magnet and pole members which form an annular magnetic flux gap and the means forming the current field comprises a tubular coil having a plurality of turns reciprocally disposed in the flux gap.

19. The combination of claim 18 wherein the magnetic field is continuous and the turns of the tubular coil are divided into discrete subsections to provide the subfields.

20. The acoustic driver comprising a tubular coil form the axis of which is disposed on an axis of reciprocation, a voice coil disposed on the coil form, permanent magnet means establishing a magnetic field which intersects the wires of the voice coil, means forming an acoustic radiating surface connected to the coil form and disposed at an angle to the axis, said means comprising a membrane section and a plurality of elongation transmission rib sections coupled to the coil form and extending radially outwardly along the radiating surface and continuously coupled to the membrane section, the transmission rib sections having a transverse dimension normal to the radiating surface of the membrane that is about an order of magnitude greater than the dimension of the membrane normal to the radiating surface, a support flange disposed around and spaced from the peripheral edge, and a plurality of metal spring members extending between the peripheral edge and the support flange for providing radial alignment of the means forming the radiating surface and for providing an axially directed spring force tending to bias the member forming the radiating surface to a predetermined axial position, and a flexible membrane forming an air seal between the means forming the acoustic radiating surface and the support flange, the membrane being attached to each of the spring members to dampen resonance of the spring members.

21. The acoustic driver of claim 26 wherein the membrane is attached to the spring members at an isolated point.

22. The acoustic driver of claim 20 wherein the membrane is attached to the spring member along substantially the entire length of the spring member.

23. The acoustic driver of claim 22 wherein the membrane is characterized by a semi-circularly shaped radial cross-sectional configuration and the spring members conform to a cross-sectional configuration of the membrane.

24. The acoustic driver of claim 23 wherein the spring members extend at a substantial angle to a line extending radially from the center of the radiating surface.

25. The acoustic driver of claim 23 wherein at least a plurality of the spring members are integral with a metal anchor plate attached to the support flange.

26. The acoustic driver of claim 22 wherein the spring members reinforce the membrane against "blow-out" by pressures generated by motion of the means forming the acoustic radiating surface.

27. The acoustic driver of claim 26 wherein the membrane is a woven fabric and the spring members are woven in with the fibers of the fabric.

28. The acoustic transducer comprising the combination of:

magnetic means for producing an annularly shaped magnetic field including a cylindrical center pole member and a circular outer pole member disposed around and spaced from the center pole to form the annularly shaped magnetic field therebetween;

coil means forming an annularly shaped alternating current field disposed in the annularly shaped magnetic field for reciprocation axially of the center pole, the coil means being in sliding contact with at least one of the poles to guide movement of the coil means relative to the magnetic means;

one of the fields being continuous and the other field being divided into axially spaced rigidly interconnected subfields of substantially equal frequency response, the subfields being spaced such that as th current field moves in one direction relative to the magnetic field, one of the subfields is coupled to said one field to an increasing degree and the other of the subfields is coupled to said one field to a decreasing degree, and as the current field moves in the other direction relative to the magnetic field, said one of the subfields is coupled to said one field to a decreasing degree and said other subfield is coupled to said one field to an increasing degree to thereby maintain a substantially constant degree of coupling between the two fields over a substantial distance of relative movement;

an acoustic radiating surface attached to and reciprocating axially with the coil means and having an outer periphery;

a rigid support member attached to the magnetic means and including an annular flange disposed adjacent the outer periphery of the acoustic radiating surface; and axially flexible means providing an annular air seal between the periphery of the radiating surface and the annular flange while providing radial alignment for the radiating surface.

29. The combination of claim 28 wherein the support means includes a flexible, semicircularly shaped edge roll having a center section that is significantly more compliant than at least one of the outer sections.

30. The combination of claim 28 wherein the current field is divided into subfields.

31. The combination of claim 28 wherein the magnetic field is divided into subfields.

32. The combination of claim 28 wherein the distance between centers of the subfields is approximately equal to the distance between the effective boundaries of said other field.

33. The combination of claim 28 wherein the means forming the elongated magnetic field includes a permanent magnet and pole members which form an annular magnetic flux gap and the means forming the current field comprises a tubular coil having a plurality of turns reciprocally disposed in the flux gap.

34. The combination of claim 33 wherein the magnetic field is continuous and the turns of the tubular coil are divided into discrete subsections to provide the subfields.

35. The combination of claim 28 wherein the axially flexible support means provides essentially the only axial spring bias to the reciprocating structure and biases the reciprocating structure to a predetermined quiescent axial position without applying radially directed tension forces to the radiating surface.

36. The combination of claim 35 wherein the spring bias is provided by a plurality of metal spring members cantilevered from the annular flange.

37. The combination of claim 28 wherein the radiating surface is formed by a plurality of narrow discrete acoustic transmission paths extending radially from the coil means along the paths approximately equal to the velocity of acoustic energy in air, and a membrane attached to the paths and having a substantially slower acoustic velocity whereby acoustic energy having wavelengths less than the length of the paths will be efficiently radiated into the air.

38. The combination of claim 37 further characterized by an air suspension enclosure extending from the annular flange and enclosing the magnetic structure.

39. The combination of claim 37 further characterized by baffle means extending from the annular flange.

* * * * *

UNITED STATES PATENT AND TRADEMARK OFFICE

CERTIFICATE OF CORRECTION

PATENT NO. : 3,983,337

DATED : September 28, 1976

INVENTOR(S) : Burton A. Babb

It is certified that error appears in the above-identified patent and that said Letters Patent are hereby corrected as shown below:

Column 8, line 33, "formed" should be —form—.

Column 8, line 35, insert —the— between "and" and "magnetic".

Column 8, line 45, "70" should be —76—.

Column 8, line 61, "(2C = S)" should be —(2C + S)—.

Column 10, line 26, "magentic" should be —magnetic—.

Column 10, line 26, insert —field— between "magnetic" and "less".

Column 10, line 33, "numberal" should be —numeral—.

Column 15, line 64, "3116" should be —3/16—.

Column 16, line 50, "referenced" should be —reference—.

Signed and Sealed this

Thirty-first Day of May 1977

[SEAL]

*Attest:*

RUTH C. MASON
*Attesting Officer*

C. MARSHALL DANN
*Commissioner of Patents and Trademarks*